US005176601A

United States Patent [19]

Reynolds

[11] Patent Number: 5,176,601

[45] Date of Patent: Jan. 5, 1993

[54] EXERCISING APPARATUS

[76] Inventor: Kelly P. Reynolds, 2100 Knoll Crest, Arlington, Tex. 76014

[21] Appl. No.: 799,553

[22] Filed: Nov. 27, 1991

[51] Int. Cl.[5] ..... H63B 21/00

[52] U.S. Cl. ..... 482/130; 482/138; 482/121; 482/123

[58] Field of Search ..... 482/138, 123, 130, 101, 482/99, 102, 44, 120, 121, 126, 129, 128, 49; 128/25 R

[56] References Cited

U.S. PATENT DOCUMENTS

| | | | |
|---|---|---|---|
| 1,929,107 | 10/1933 | Weaver | 482/102 |
| 1,969,901 | 8/1934 | Pilates | 482/130 |
| 1,973,945 | 9/1934 | Chavin et al. | 482/130 |
| 2,223,309 | 11/1940 | Swanson . | |
| 3,738,649 | 6/1973 | Miller | 482/130 |
| 3,784,195 | 1/1974 | Johnson . | |
| 3,985,354 | 10/1976 | Schulkin | 482/123 |
| 3,992,004 | 11/1976 | Feron et al. . | |
| 4,111,417 | 9/1978 | Gardner . | |
| 4,556,217 | 12/1985 | Kochan . | |
| 4,619,454 | 10/1986 | Walton . | |
| 4,726,580 | 2/1988 | Batiste et al. . | |
| 4,921,247 | 5/1990 | Sterling | 482/138 |
| 4,922,892 | 5/1990 | Akcelrod et al. . | |
| 5,044,633 | 9/1991 | Rice | 482/130 |

*Primary Examiner*—Richard J. Apley
*Assistant Examiner*—Jerome Donnelly
*Attorney, Agent, or Firm*—Hubbard, Thurman, Tucker & Harris

[57] ABSTRACT

An exercising apparatus is provided permitting the concurrent isometric stressing of the leg muscles while performing a plurality of arm stressing exercise, or alternatively, permitting an isometric stress to be maintained in the arm muscles in a selected direction while exercising the leg muscles. All of the exercising stresses are produced by compressing springs in tubular housings, some of which constitute the frame structure of the exercising apparatus and other tubular housings being positioned in a plurality of angular positions relative to the frame structure.

18 Claims, 4 Drawing Sheets

EXERCISING APPARATUS

BACKGROUND OF THE INVENTION

1. FIELD OF THE INVENTION

This invention relates to an apparatus for permitting a plurality of exercises to be performed by the arms and legs of the user, and particularly an apparatus that will permit the imposition of an isometric stress on the leg muscles while the arm muscles are subjected to a variety of different exercises.

2. SUMMARY OF THE PRIOR ART

There is a multitude of prior art patents dealing with exercising devices. The great majority of such prior art devices are single purpose devices, i.e., the apparatus is designed to perform a single type of exercise whether it be a push out of the legs, push up exercises by the arms, push out exercises by the arms, or pull up exercises by the arms. Even in the sophisticated commercial exercise salons, the commonly used Nautilus machines are invariably designed to perform exercises with only a single set of muscles employed. Hence, to go through an entire sequence of desirable exercises for the arms, it is necessary to spend time on a minimum of four different Nautilus machines.

Exercises are generally performed against a restraining force applied either by lifting a selected number of weights or by compression of springs. To provide an exercise device that is suitable for use in the home, hence occupying a minimum of space, the utilization of springs as the force resisting element is a common practice. Moreover, it has been a common practice to enclose such springs within tubular guide elements which also function as part of frame of the exercising apparatus. See, for example, U.S. Pat. Nos. 4,111,417, 4,726,580 and 4,619,454. None of these patents, however, disclose a single apparatus having the capability of performing a plurality of arm exercises concurrently with optionally maintaining an isometric stress on the legs.

SUMMARY OF THE INVENTION

An apparatus embodying this invention comprises an elongated, generally rectangular base frame formed by welding two elongated tubes in parallel relationship by a plurality of transverse frame members. A seat is secured to one longitudinal end of the base frame. The ends of the tubular members remote from the seat have open ends and a pair of rods are respectively slidably mounted in the open ends of said tubular members and project out of such open ends. A foot rest is transversely secured to the projecting ends of the rods. A spring is provided within each tubular member to engage the respective rod to bias the rod and the footrest toward the seat.

A back support frame is provided comprising a pair of back support frame members which are respectively pivotally secured at their lower ends to the sides of the seat frame. Means are provided for securing the back support frame members in any selected one of a plurality of upwardly projecting, angular positions relative to the seat frame. A back support pad is secured to the back support frame to engage the back of a user sitting on the seat. Thus, when the user is sitting on the seat, the legs of the user are substantially bent at the knees in order to place the users feet on the footrest. Extending the legs toward a straightened, horizontal position will be opposed by a compression of the springs mounted in the tubular frame members and produce an isometric stress on the leg muscles as long as such compression force is maintained.

To provide adequate support to the back rest frame when it is in any one of its selected angular positions with respect to the base frame, (and prevent tip-over of the entire apparatus) a telescopically adjustable length, floor engaging support frame is pivotally secured at its upper ends to the back rest frame and at its lower ends mounts floor engaging foot elements having pivotal connections with the bottom of the telescoped support legs. A pin traverses the outer and inner elements of each telescoped support leg to lock the support legs in a length selected to provide the desired angular position of the back rest frame relative to the main frame.

On the upper portions of the back support frame members, a tubular spring housing is rigidly secured in a horizontal position. A pair of tension rods are respectively inserted in each end of the tubular spring housing and a compression spring is mounted around each rod and secured between a nut or head on the inner end of the rod and an annular end cap provided on the respective ends of the spring housing. A manually graspable handle is secured to the outwardly projecting end of each rod in generally radial relationship thereto. Thus, when the manually graspable handles are grasped by the user, the user may apply a sidewardly directed, outward force on each handle which is resisted by the compression of the springs within the spring housing. To change the initial position of the arms for applying such force, an alternative handle is secured to each rod end which is located substantially closer to the back support frame than the originally mentioned handles. This means that the initial exercise movement can start with the arms being completely folded at the elbow and positioned closely adjacent to the sides of the body of the user.

Obviously, an isometric stress may be concurrently applied to the legs by maintaining a pushing force on the foot rest.

To provide an overhead press exercise, a pair of overhead press cylinders are welded to the front sides of the back support frame members in parallel relationship thereto, thus becoming part of the back support frame work. The back support pad may be conveniently snapped onto the back support overhead press cylinders. Each overhead press cylinder is provided with a rod which is inserted through the open top end of the respective cylinder and a compression spring is mounted in surrounding relationship to such rod and operates between a nut or head on the inserted end of the rod and an annular end cap provided on the upper end of each overhead press cylinder. A manual grasping handle is secured to the outer end of each rod in generally radial relationship to permit convenient grasping by the hand at a position generally adjacent to the head of the user. Thus, an upward force may be exerted on both rods, which is resisted by the springs surrounding the rods and mounted within the overhead press cylinders.

To provide an exercise involving the forward push-out of the arms in a selected one of a plurality of vertical angular directions against a spring resistance, a pair of cylinders are respectively pivotally secured to the side of the back support members and are laterally adjustable to conform to the shoulder width of the user. The pivot mounting may be rigidified by tightening of a wing nut to permit selection of a desired angular direction of the push-out exercise. A rod is inserted in each cylinder and has a nut or head on the inserted end thereof cooperating with a compression spring which engages an annular end cap provided at the top end of the pivoted cylinders. A radially disposed manually graspable handle is again provided on the front end of each rod projecting out of the pivot cylinders and thus the described exercise of raising the arms from a horizontal position to an overhead position against the bias of the springs may be accomplished.

Lastly, an arm pulling exercise may be performed by pivotally mounting two more cylinders, substantially identical to those previously described, to the forward portions of the bottom frame so that the grasping handles are positioned in the vicinity of the knees of the user. Such handles may be grasped and then pulled back on the handles against the resistance of the springs in the respective pivoted cylinders.

With each of the aforedescribed arm exercising devices, an isometric tension may be maintained on the leg muscles by pushing forwardly against the foot rest. Conversely, the foot rest may be cyclically pushed forward by the legs while an isometric tension is applied to the arm muscles in a selected direction by utilizing either the side thrust handles, the overhead press handles or either pair of pivot cylinder handles. Thus the combination of an isometric tension in one part of the body coupled with a dynamic tension in another part of the body provides a very desirable and unique exercise combination.

Further objects and advantages of this invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figures 1, 2:
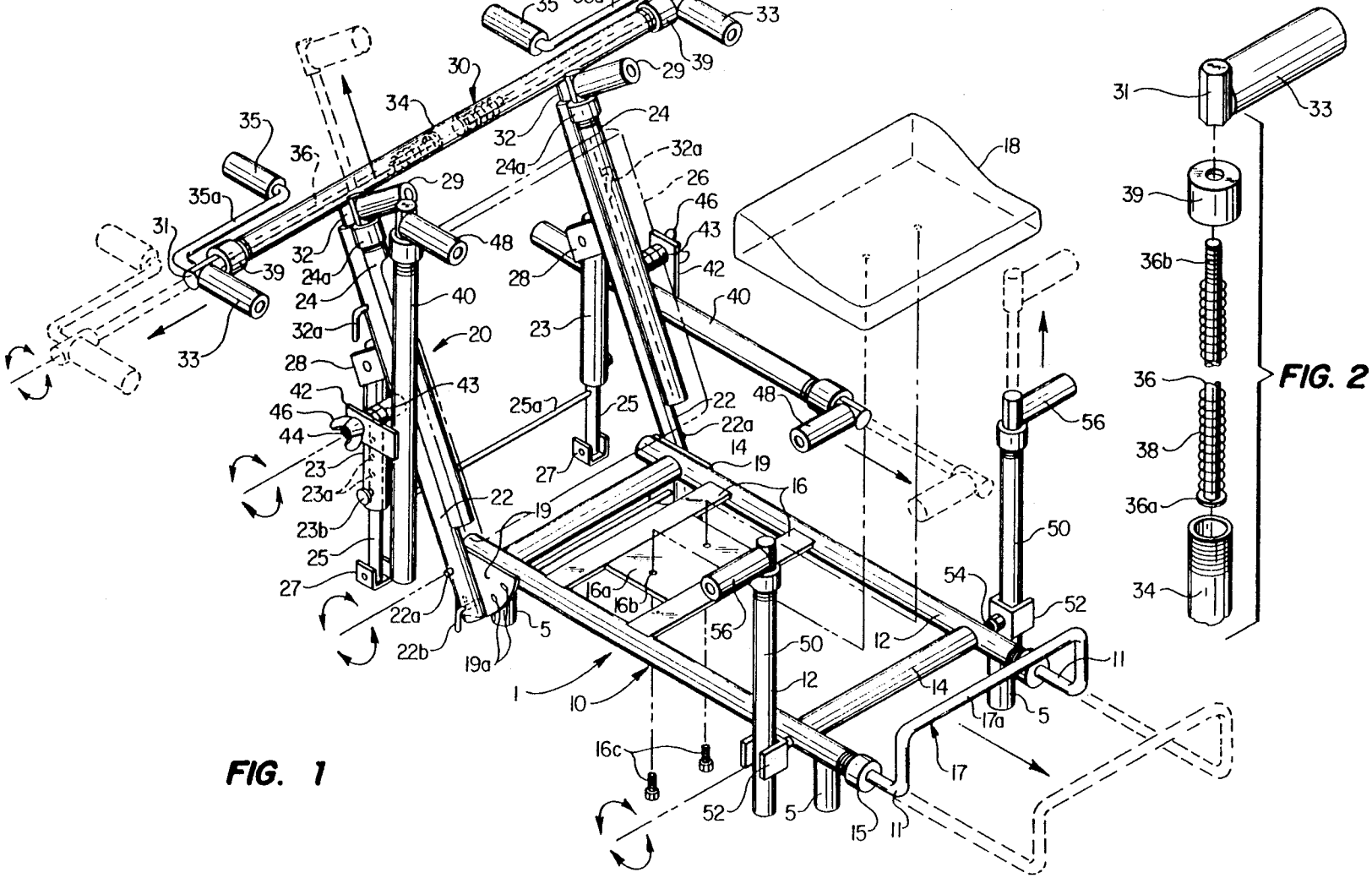
FIG. 1 is an exploded perspective view of an exercising apparatus embodying this invention
FIG. 2 is a partial exploded view of the side press cylinders which is typical of the construction of many of the exercising cylinders employed in the apparatus of FIG. 1.

Referring to FIG. 1, the apparatus 1 embodying this invention comprises a generally rectangular support frame 10 formed by the welded assemblage of tubular members. Support frame 10 includes two longitudinally extending tubular members 12, which also function as spring retaining cylinders, and are secured in parallel relationship by a plurality of transverse tubular elements 14 welded to the longitudinal tubular members 12. Four legs 5 are welded to tubular members 12 in depending relationship.

Adjacent the rearward portions of the bottom frame structure 10, a pair of straps 16 are welded in transverse relationship to the longitudinal members 10 and a seat mounting plate **16*a* is welded to the straps 16 and defines holes 16*b* for the passage of bolts 16*c* by which a seat 18 can be rigidly secured to the bottom frame 10. While seat 18** is illustrated as being essentially a one piece member, obviously, such seat could comprise a bottom element to which is conventionally secured an upholstered or otherwise cushioned seat.

Figure 3:
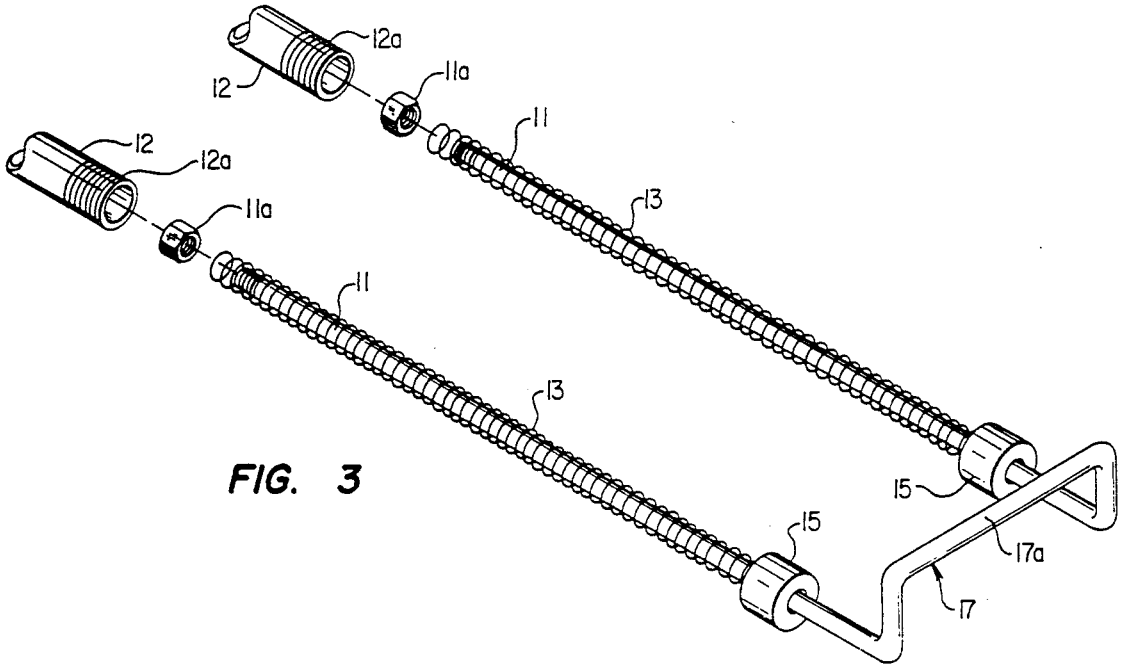
FIG. 3 is an exploded perspective view of the cylinders employed for the leg exercising portion of the apparatus of FIG. 1.

The forward ends of the longitudinal tubular members 12 are open and are externally threaded as indicated at **12*a* in FIG. 3. A pair of spring compression rods 11 are respectively inserted in the open ends 12*a* and are respectively surrounded by compression springs 13. A nut 11*a* is secured to the inner end of each spring mounting rods 11 to effect compression of the springs 13 against internally threaded annular end caps 15 which are respectively secured to the threaded end portions 12*a* of the tubular frame elements 12**.

The compression rods 11 extend outwardly through the annular end caps 15 and are joined by a U-shaped transverse rod 17 which functions as a support for the feet of the user. Obviously, a foot support plate can be secured to the bight portion **17*a* of U-shaped transverse rod 17 if desired. In any event, the application of an outward force to the transverse footrest rod 17 will effect a compression of the springs 13 by the nuts 11*a***.

At the rear end of the base frame 10, an upstanding back support frame 20 is adjustably secured to project upwardly in any selected one of a plurality of vertical angles. Thus, back frame 20 comprises a pair of tubular elements 22 which are respectively mounted on pivot pins **22*a* traversing the bottom frame tubular members 12 and quadrant-shaped plates 19 welded to the rear ends of the tubular bottom frame elements 12. Each plate 19 has a plurality of arcuately spaced holes 19*a* and a manually insertable rod 22*b* traverses the bottom end of each back support frame element 22 and enters a selected aligned pair of the holes 19*a* provided in the quadrant-shaped plates 19**.

A pair of overhead press cylinders 24 are respectively secured to the front faces of the back support frames 22 by welding. A back rest 26 is then secured to each of the cylinders 24 by conventional snap on clips (not shown). Thus, the back support frame 20 is rigidified by the back rest 26.

To prevent tip over of the apparatus when a backward force is exerted against the back rest 26, a bracket 28 is secured to the rear face of each of the back support frames 22 and pivotally mount a floor engaging structure. This structure comprises a pair of outer tubes 23 which telescopically receive in their bores a pair of floor engaging inner rods or tubes 25. Floor engaging support members 27 are respectively pivotally mounted to the bottom ends of the inner tubes 25. The inner floor engaging tubes 25 are interconnected by a transverse rod **25*a* to insure concurrent movement of such tubes relative to the outer tubes 23. Both the outer tubes 23 and the inner tubes 25 are traversed by a plurality of vertically spaced, threaded holes 23*a* and manually insertable bolts 23*b* respectively traverse a selected pair of holes 23*a* to lock the inner tubes 25 in a selected longitudinal position relative to the outer tubes 23 to insure that the back support frame 20** is rigidly supported by the floor engaging support structure.

The tubular frame elements 22 are both open at their upper ends to respectively receive a pair of rods 32 forming part of a side press exercising apparatus 30. Such side press apparatus comprises a horizontally extending tubular spring guide 34 which is welded to the ends of the rods 32. The height of spring guide 34 is adjustable by pins 32*a* which traverse vertically spaced holes in frame elements 22 and rods 32. Within the spring guide 34, and respectively projecting out of opposite ends thereof, are a pair of spring compressing rods 36. As best shown in the schematic exploded view of FIG. 2, the inner end of each compressing rod has an enlarged head or nut 36*a* formed thereon which compresses a spring 38 surrounding each rod 36.

The outer end of each compressing rod 3 is provided with threads 36*b* which project out through an annular collar 39 and is threadably engaged in a hexagonally-shaped block 31 to which is threadably mounted a pair of handles 33 and 35. The handles 33 are mounted adjacent to the hexagonal block 31, while the handles 35 are positioned a substantial distance laterally inwardly relative to the handles 33 but being mounted on a generally Z-shaped rod 35*a* which has one end threadably secured to the hexagonal nut 31.

Thus a side pressing exercising apparatus is provided for the arms of the user in which the exercising force can be initiated from a position of the arms folded closely adjacent the sides of the body of the user and grasping handles, or a more outward position of the arms relative to the sides of the body, in which case the handles 33 would be grasped.

The cylinders 24, which have been previously mentioned, house a push-up exercising apparatus comprising essentially the same structure as shown in FIG. 2, namely a spring compression rod, a spring, a annular threaded collar 24*a* secured to the end of each tube 24 and a handle 29 secured to the outer end of the compression rod. Since this structure is functionally identical that shown in FIG. 2, further description or illustration thereof is believed unnecessary.

A pair of forward press cylinders 40 are also provided and are respectively medially pivotally mounted to the tubular back frames 22. The cylinders 40 each have a laterally extending mounting bracket 42 welded to a medial portion and mounting brackets 42 are respectively traversed by mounting bolts 44 which are welded in horizontally projecting relationship to the back support frame elements 22. The lateral spacing of the cylinders 40 can be selectively adjusted by inserting a selected number of spacers 43 between the bracket 42 and the sidewall of the back support frame 22. Also, the cylinders 40 may be permitted to pivot about the shaft 44 for exercising purposes, or, preferably, the cylinders 40 are both locked in a selected angular position by tightening of a wing nut 46 on the end of the bolts 44. Thus, as shown in Figure 1, the forward press cylinders 40 may be alternatively disposed in a relatively high angular position with respect to the floor as shown by the right hand cylinder 40 or disposed in a substantially horizontal position as shown by the left hand cylinder 40 in Figure 1. Of course, both cylinders 40 will normally be disposed in the same angular position. Obviously, the more horizontal position permits the application of exercising stress to the back as the handles 48 are extended. The internal construction of the forward press cylinders 40 is substantially identical to that shown in FIG. 2 and will not be further described.

Lastly, a pair of pull-up cylinders 50 are respectively pivotally mounted adjacent the forward ends of the base support tubular elements 12. The pull-up cylinders 50 are each welded to a U-shaped bracket 52 which is in turn is conventionally pivotally mounted to the end of rods 54 which are attached to the outside of tubular members 12. Again the internal construction of the pull-up cylinders 50 is substantially identical to that shown in FIG. 2 and the spring compressing rods respectively extend out of the cylinders 50 and are respectively secured to handles 56.

Figure 4:
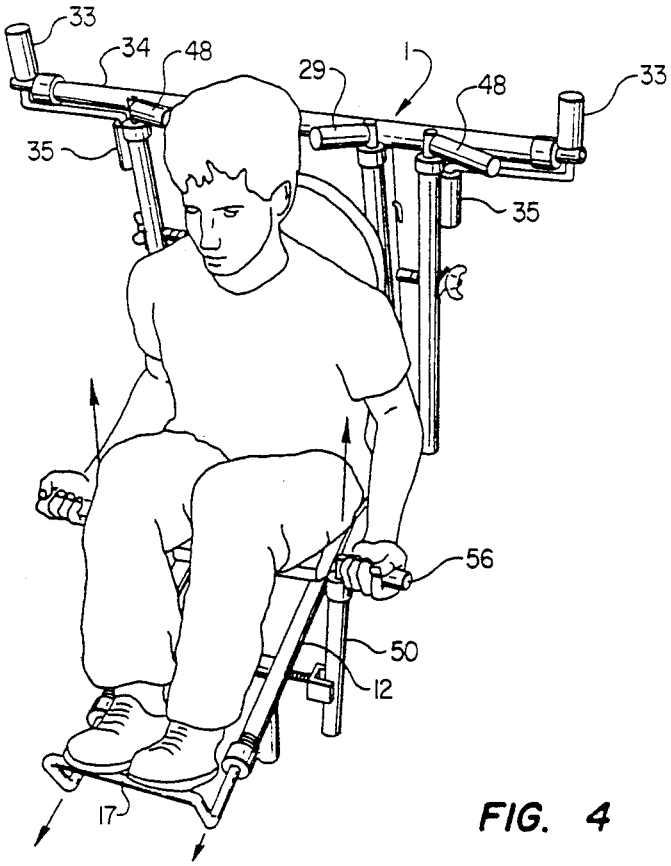
FIG. 4 is a perspective view illustrating the initial position of a user of the apparatus of FIG. 1 for concurrently exercising the legs and exerting a pull-up force on the arms of the user.
Figure 5:
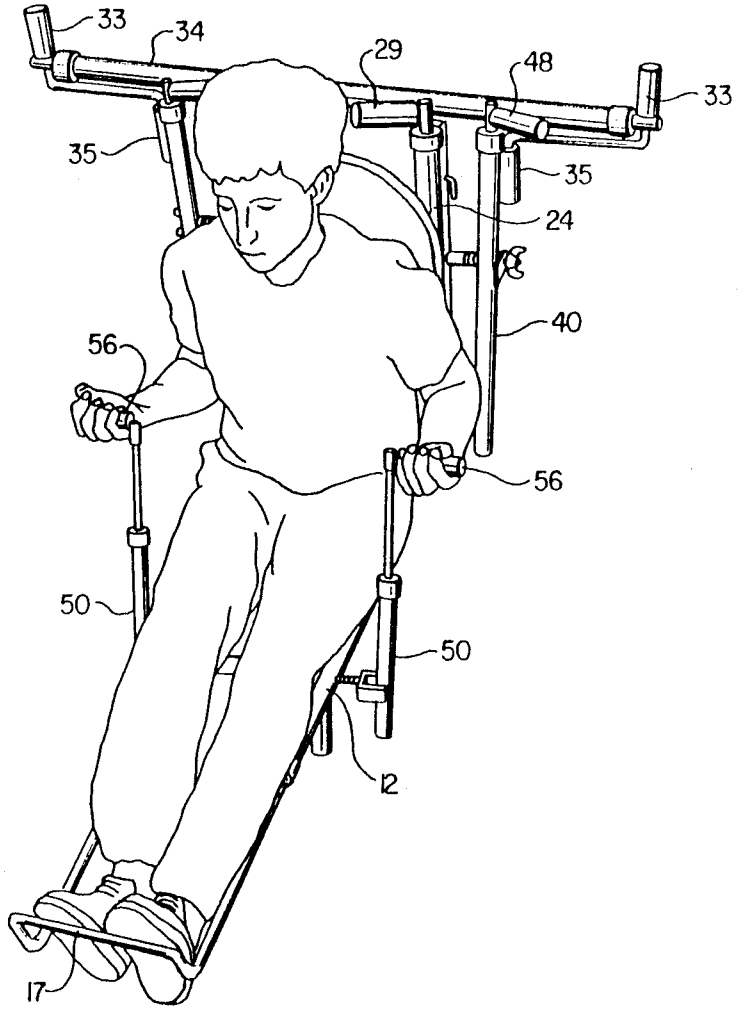
FIG. 5 is a perspective view similar to FIG. 4 but showing the position of the user's body during the application of an isometric stress to the legs and a pull-up stress to the arms.

Referring to FIG. 4, the initial position of the user on the apparatus of FIG. 1 is illustrated. It is assumed that the user wants to maintain an isometric stress on his legs while exercising the arms by a pull-up motion. This condition is illustrated in FIG. 5 where the legs have been extended fully forward against the bias of the springs 13, thus producing a substantial isometric stress on the legs, while the handles 56 of the pull-up cylinders 50 have been raised upwardly, thus exerting stresses on the arms. The arms can be maintained in the illustrated position and the legs cyclically moved from the position of FIG. 4 to the position of FIG. 5 if that form of exercise is desired. Conversely, the legs may be maintained in an isometrically stressed condition as shown in FIG. 5 and the arms cyclically exercised by moving the handles 56 upwardly and then downwardly.

Figure 6:
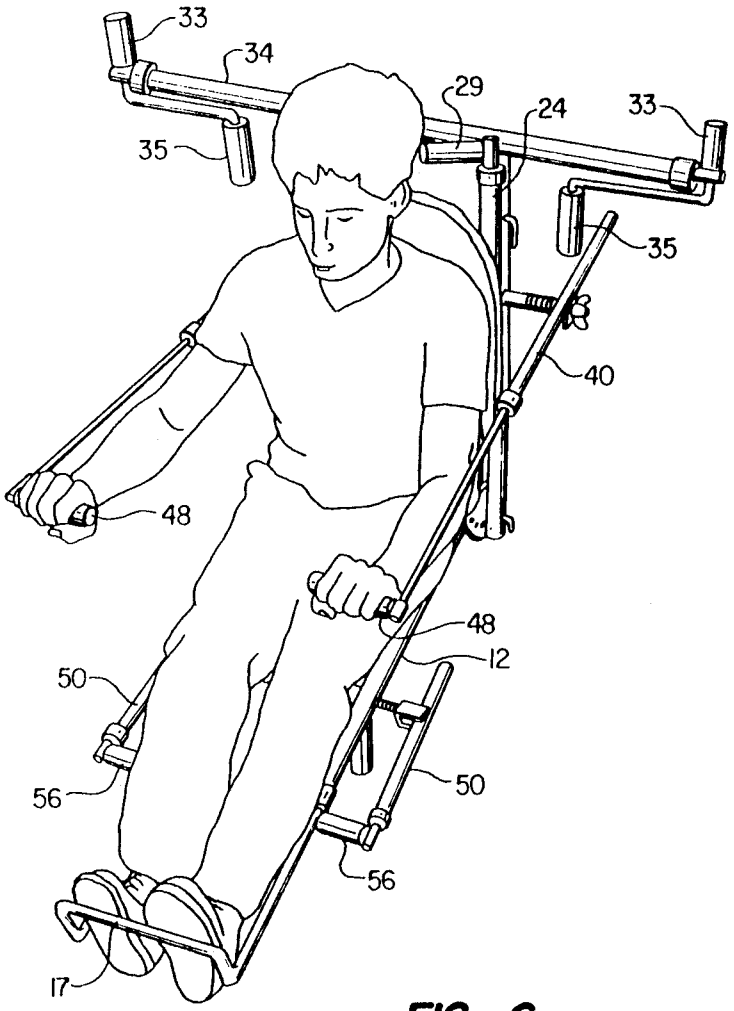
FIG. 6 is a perspective view showing the maintenance of a full isometric stress on the legs while exercising the arms by a push-forward motion.

Referring to FIG. 6, there is shown the concurrent stressing of the legs accompanied by stressing of the arms by a push-forward exercise using the push forward cylinders 40.

Figure 8:
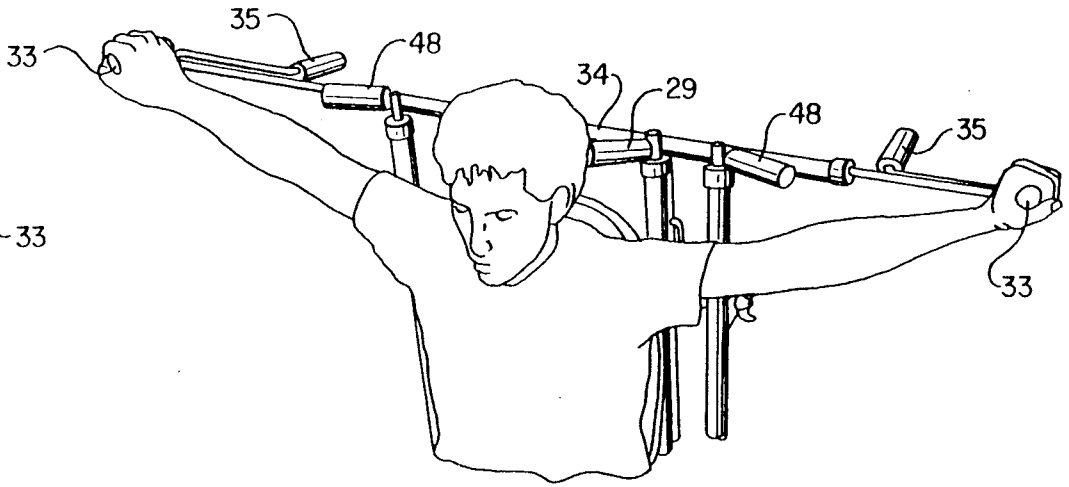
FIG. 8 is a perspective view illustrating the exercising of the arms by a sidewise press at shoulder level.
Figure 7:
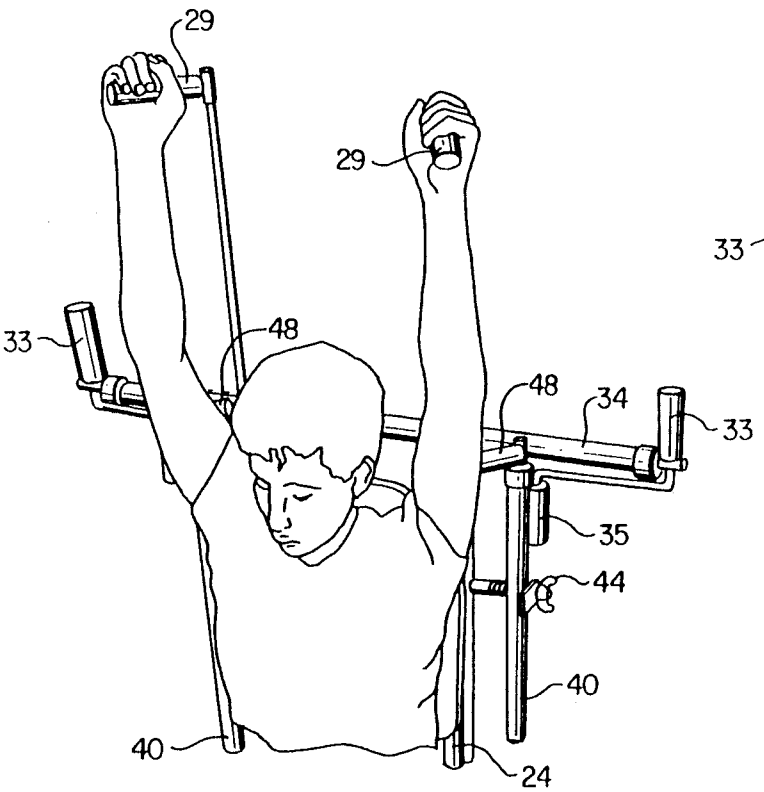
FIG. 7 is a perspective view illustrating the upward press exercising of the arms.

In FIG. 7, the operation of the overhead press cylinders 24 by grasping the handles 29 is illustrated. In FIG. 8, the side press exercise utilizing the cylinder 34 and the outermost handles 33 is illustrated. In the exercises of both FIG. 7 and FIG. 8, an isometric stress may be maintained on the legs, or conversely, the legs may be exercised while maintaining an isometric stress on the arms in the selected direction.

It will be readily apparent from the aforegoing description, that the exercising apparatus embodying this invention is completely adjustable to meet the needs of the user, regardless of whether the user is male, female, reasonably large or reasonably small. The lateral adjustments for the forward press cylinders 40 permit accommodation of any reasonable shoulder width. The provision of the two differently located handles 33 and 35 for the outward press exercises, again permits the device to be used by either a broad or narrow shouldered individual. The two differently located handles 33 and 35 also provide for different tension settings with one set of handles providing for less strenuous use. The height of side press cylinder 34 is readily adjustable. Most importantly, isometric stresses may be maintained on the legs while performing any selected one of the arm exercises, or conversely, an isometric stress may be imposed on the arms in a plurality of different directions while the legs are actively exercised by cyclically pushing the footrest bar 17 forwardly against the spring bias and then releasing the forward pressure.

All of the aforedescribed compression springs utilized in the exercising apparatus are designed to reach a solid condition before any excessive stress is imposed thereon by the user. This design feature substantially eliminates breakage of the springs during use of the apparatus.

Modifications of this invention will be readily apparent to those skilled in the art and all such modifications should be included within the scope of the appended claims.

What is claimed and desired to be secured by Letters Patent is:

1. A multi-purpose exercising machine comprising, in combination:

an articulated base frame comprising a pair of elongated tubular members connected in parallel relationship by a plurality of transverse members to define a generally rectangular base frame;

a seat secured to one longitudinal end of said base frame;

said tubular members having open ends remote from said seat, with a cap affixed to the end of each of said tubular members, said caps having a central bore therethrough with the interior of said caps forming an inwardly extending shoulder:

a rod slidably mounted in each tubular member having an end projecting through the central bore in one of said caps and out of the open end of each tubular member said rods having within the respective tubular members, an internal shoulder for supporting the end of a spring:

a foot rest transversely secured to the projecting ends of said rods;

a spring within each said tubular member extending between the inwardly extending shoulder of a cap and the internal shoulder of a respective rod to bias said rods and foot rest toward said seat;

a back support frame comprising a pair of elongated back support frame members respectively pivotally secured at their lower ends to the sides of said seat frame;

means for securing said back support frame members in a selected one of a plurality of upwardly projecting angular positions relative to said seat frame;

a back support element secured to said back support frame members to engage the back of a user sitting on said seat;

a tubular spring housing having opposite open ends secured in a horizontal position to the upper portions of said back support frame members, with a cap affixed to each opposite end of said tubular spring housing, said caps each having a central bore therethrough and the interior of said caps forming an inwardly extending shoulder;

a tension rod inserted in each opposite end of said tubular spring housing, each rod having an end projecting through the central bore in a cap and out of the respective opposite ends of said tubular spring housing, said rods each having an internal shoulder within said tubular housing for supporting the end of a spring:

one of a pair of springs respectively operatively disposed in each open end of each said tubular spring housing, each spring being captured between the internal shoulder of a tension rod and the inwardly extending shoulder of the cap through which said rod passes to respectively bias said rods inwardly relative to said spring housing; and a manually graspable handle respectively secured to the external end of each rod, whereby a push out force may be exerted by the arms of the user concurrently with a leg straightening force exerted by the legs of the user on said foot rest.

2. The apparatus of claim 1 wherein said means for securing said back support frame members in a plurality of upwardly projecting angular positions comprises an adjustable length floor engaging support secured in depending relationship to the medial portions of said back support frame members.

3. The apparatus of claim 1 further comprising a second pair of manually graspable handles; and means for respectively securing said second pair of manually graspable handles to the outer ends of said tension rods to position said second pair of manually graspable handles substantially closer to said back support frame members than said first mentioned pair of manually graspable handles.

4. The apparatus of claim 1 further comprising:

a first pair of exercising cylinders respectively secured in general parallel relationship to said back support frame;

said first pair of exercising cylinders respectively having rods inserted therein, springs opposing outward movement of said rods, and manually graspable handles secured to the ends of said rods projecting out of said first pair o exercising cylinders, thereby permitting push up exercising of the arms of the user.

5. The apparatus of claim 1 further comprising:

a pair of horizontal pins respectively coaxially secured to medial portions of said back support frame members; a pair of exercising cylinders respectively pivotally secured to said horizontal pins for movement in a vertical plane;

said second pair of exercising cylinders respectively having rods inserted in the forward ends thereof, springs opposing forward movement of said rods, and a pair of manually graspable handles secured to the ends of said rods projecting forwardly out of said second pair of exercising cylinders, thereby permitting forward pushing exercising of the arms of the user in a plurality of angularly spaced directions in a vertical plane.

6. The apparatus defined in claims 1, 2, 3, 4 or 5 further comprising a third pair of exercising cylinders respectively coaxially pivoted to opposite sides of said base frame at a location intermediate said foot rest and said back support frame for movement in a vertical plane;

said third pair of exercising cylinders respectively having rods inserted in the upper ends of said third pair of exercising cylinders, springs opposing outward movement of said rods and manually graspable handles secured to the upper ends of said rods, thereby permitting pull-up exercising of the arms and back of the user.

7. The apparatus of claim 2 wherein said means for securing said back support frame members in a plurality of upwardly projecting angular positions further comprises pair of plates respectively secured in depending relation to said back support frame members;

said plates each having a row of holes arcuately spaced around the pivot axis of said back support frame members; and a pin traversing the bottom end of each back support frame member and selectively engagable with one of said arcuately spaced holes in each said plate.

8. A multi-purpose exercising machine comprising, in combination:

an articulated base frame comprising a pair of elongated tubular members connected in parallel relationship by a plurality of transverse members to define a generally rectangular base frame;

a seat secured to one longitudinal end of said base frame;

said tubular members having open ends remote from said seat, with a cap affixed to the end of each of said tubular members, said caps having a central bore therethrough with the interior of said caps forming an inwardly extending shoulder;

a rod slidably mounted in each tubular member having an end projecting through the central bore in one of said caps and out of the open end of each tubular member, said rods having within the respective tubular members, an internal shoulder for supporting the end of a spring;

a foot rest transversely secured to the projecting ends of said rods;

a spring within each said tubular member extending between the inwardly extending shoulder of a cap and the internal shoulder of a respective rod to bias said rods and foot rest toward said seat;

a back support frame comprising a pair of elongated back support frame members respectively pivotally secured at their lower ends to the sides of said seat frame;

means for securing said back support frame members in a selected one of a plurality of upwardly projecting angular positions relative to said seat frame;

a back support element secured to said back support frame members to engage the back of a suer sitting on said seat;

a pair of tubular spring housings secured to said back support frame members in generally parallel relation, said tubular housings having a cap affixed to the end of each of said tubular housings, said caps having a central bore therethrough with the interior of said caps forming an inwardly extending shoulder;

a tension rod inserted in the end of each tubular spring housing, the rods each having an end projecting through the central bore of a cap and out of the end of a tubular spring housing, said rods having an internal shoulder within the respective tubular spring housing for supporting the end of a spring;

a spring operatively disposed in each spring housing, each spring being captured between the internal shoulder of a tension rod and the inwardly extending shoulder of a cap through which said rod passes to respectively bias said rods inwardly relative to said spring housing; and a manually graspable handle secured to the external end of each rod, whereby a pushup force may be exerted by the arms of the user concurrently with a leg straightening force exerted by the legs of the user on said foot rest.

9. The apparatus of claim 8 wherein said means for securing said back support frame members in a plurality of upwardly projecting angular positions comprises an adjustable length floor engaging support secured in depending relationship to the medial portions of said back support frame members.

10. The apparatus of claim 8 further comprising:

an open ended tubular housing secured to the upper portion of said back support frame in horizontal relationship;

a pair of rods inserted in each end of said tubular housing;

springs respectively opposing outward movement of said rods, and manually graspable handles respectively secured to the ends of said rods projecting out of said tubular housing, thereby permitting sideward press exercising of the arms of the user.

11. The apparatus of claim 8 further comprising:

a pair of horizontal pins respectively coaxially secured to medial portions of said back support frame members;

a pair of exercising cylinders respectively pivotally secured to said horizontal pins for movement in a vertical plane;

said pair of exercising cylinders respectively having rods inserted in the forward ends thereof, springs opposing forward movement of said rods, and a pair of manually graspable handles secured to the ends of said rods projecting forwardly out of said pair of exercising cylinders, thereby permitting forward pushing exercising of the arms of the user in a plurality of angularly spaced directions in a vertical plane.

12. The apparatus defined in claims 8, 9, 10 or 11 further comprising a second pair of exercising cylinders respectively coaxially pivoted to opposite sides of said base frame at a location intermediate said foot rest and said back support frame for movement in a vertical plane;

said second pair of exercising cylinders respectively having rods inserted in their upper ends, springs opposing outward movement of said rods and manually graspable handles secured to the upper ends of said rods, thereby permitting pull up exercising of the arms and back of the user.

13. The apparatus of claim 9 wherein said means for securing said back support frame members in a plurality of upwardly projecting angular positions further comprises a pair of plates respectively secured in depending relation to said elongated back support frame members;

said plates each having a row of holes arcuately spaced around the pivot axis of said back support frame members; and a pin traversing the bottom end of each back support frame member and selectively engagable with one of said arcuately spaced holes in each said plate.

14. A multi-purpose exercising machine comprising, in combination:

an articulated base frame comprising a pair of elongated tubular members connected in parallel relationship by a plurality of transverse members to define a generally rectangular base frame;

a seat secured to one longitudinal end of said base frame;

said tubular members having open ends remote from said seat, with a cap affixed to the end of each of said tubular members, said caps having a central bore therethrough with the interior of said caps forming an inwardly extending shoulder, a rod slidably mounted in each tubular member having an end projecting through the central bore in one of said caps and out of the open end of each tubular member, said rods having within the respective tubular members, an internal shoulder for supporting the end of a spring:

a foot rest transversely secured to the projecting ends of said rods;

a spring within each said tubular member extending between the inwardly extending shoulder of a cap and the internal shoulder of a respective rod to bias said rods and foot rest toward said seat;

a back support frame comprising a pair of elongated back support frame members respectively pivotally secured at their lower ends to the sides of said seat frame;

means for securing said back support frame members in a selected one of a plurality of upwardly projecting angular positions relative to said seat frame;

a back support element secured to said back support frame members to engage the back of a user sitting on said seat;

a pair of horizontal pins respectively coaxially secured to medial positions of said back support frame members;

a pair of exercising cylinders respectively pivotally secured to said horizontal pins for movement in a vertical plane, said cylinders having forward open ends upon which a cap is affixed, said caps having a central bore therethrough with the interior of said caps forming an inwardly extending shoulder;

said pair of exercising cylinders each having a rod extending from the forward end thereof, through the central bore in one one of said caps, said rods having within the respective exercising cylinders, an internal shoulder for supporting the end of a spring;

springs mounted on each rod between the inwardly extending shoulder of a cap and the internal shoulder of the rod, opposing forward movement of said rods, and manually graspable handles secured to the ends of said rods, thereby permitting forward pushing exercising of the arms of the user in a plurality of angularly spaced directions in a vertical plane.

15. The apparatus of claim 14 further comprising spacer means on said horizontal pins for adjusting the lateral spacing of said exercising cylinders relative to each other.

16. The apparatus of claims 14 or 15 wherein said horizontal pins have threaded end portions; and nut means respectively engaging said threaded and portions to clamp said exercising cylinders in any selected angular position in a vertical plane.

17. A multi-purpose exercising machine comprising, in combination:

an articulated base frame comprising a pair of elongated tubular members connected in parallel relationship by a plurality of transverse members to define a generally rectangular base frame;

a seat secured to one longitudinal end of said base frame;

said tubular members having open ends remote from said seat, with a cap affixed to the end of each of said tubular members, said caps having a central bore therethrough with the interior of said caps forming an inwardly extending shoulder;

a rod slidably mounted in each tubular member, having an end projecting through the central bore in one of said caps and out of the open end of said tubular member, said rods having within the respective tubular members, an internal shoulder for supporting the end of a spring:

a foot rest transversely secured to the projecting ends of said rods;

a spring within each said tubular member, extending between the inwardly extending shoulder of a cap and the internal shoulder of a respective rod to bias said rods and foot rest toward said seat;

a back support frame comprising a pair of elongated back support frame members respectively pivotally secured at their lower ends to the sides of said seat frame;

means for securing said back support frame members in a selected one of a plurality of upwardly projecting angular positions relative to said seat frame;

a back support element secured to said back support frame members to engage the back of a user sitting on said seat;

a pair of exercising cylinders respectively coaxially pivoted to opposite sides of said base frame at a location intermediate said foot rest and said back support frame for movement in a vertical plane, said cylinders having open upper ends upon which a cap is affixed, said caps having a central bore therethrough with the interior of said caps forming an inwardly extending shoulder;

said pair of exercising cylinders respectively each having a rod having an end extending from the upper end thereof out of said exercising cylinders through the bore in cap, each rod having within the exercising cylinder an internal shoulder, a spring in each exercising cylinder, captured between the internal shoulder of the rod and the inwardly extending shoulder of a cap, the springs opposing outward movement of said rods, and manually graspable handles secured to the ends of said rods, thereby permitting pull up exercising of the arms and back of the user.

18. The apparatus of claim 17 further comprising:

an open ended tubular housing secured to the upper portion of said back support frame in horizontal relationship;

a pair of rods inserted in each end of said tubular housing;

springs respectively opposing outward movement of said rods, and manually graspable handles respectively secured to the ends of said rods projecting out of said tubular housing, thereby permitting sideward press exercising of the arms of the user.

* * * * *

UNITED STATES PATENT AND TRADEMARK OFFICE

CERTIFICATE OF CORRECTION

PATENT NO. : 5,176,601

DATED : January 5, 1993

INVENTOR(S) : Reynolds

It is certified that error appears in the above-identified patent and that said Letters Patent is hereby corrected as shown below:

In column 5, line 18, delete "3" and add --36--.

In column 8, line 23, delete "o" and add --of--.

In column 9, line 30, delete "suer" and add --user--.

In column 11, line 14, delete "positions" and add --portions--.

In column 11, line 42, delete "and" and add --end--.

In column 12, line 36, add --a-- between "in" and "cap".

Signed and Sealed this

Twenty-sixth Day of October, 1993

*Attest:*

*Attesting Officer*

Bruce Lehman

BRUCE LEHMAN

*Commissioner of Patents and Trademarks*